US008702529B2

(12) United States Patent
Paxton et al.

(10) Patent No.: US 8,702,529 B2
(45) Date of Patent: Apr. 22, 2014

(54) SYSTEMS AND METHODS FOR IMPROVING A GOLF SWING OR PUTTING STROKE

(75) Inventors: Silvya Paxton, Darien, GA (US); Henry Ash, St. Simons Island, GA (US)

(73) Assignee: QPutt, LLC, Darien, GA (US)

( * ) Notice: Subject to any disclaimer, the term of this patent is extended or adjusted under 35 U.S.C. 154(b) by 0 days.

(21) Appl. No.: 13/594,662

(22) Filed: Aug. 24, 2012

(65) Prior Publication Data

US 2013/0053159 A1 Feb. 28, 2013

Related U.S. Application Data

(60) Provisional application No. 61/526,866, filed on Aug. 24, 2011.

(51) Int. Cl.
*A63B 69/36* (2006.01)

(52) U.S. Cl.
USPC ..... 473/211

(58) Field of Classification Search
USPC ..... 473/207.208, 209, 211–217
See application file for complete search history.

(56) References Cited

U.S. PATENT DOCUMENTS

| | | | | |
|---|---|---|---|---|
| 2,191,683 | A * | 2/1940 | Roberts | 473/211 |
| 3,456,211 | A * | 7/1969 | Koester | 372/6 |
| 5,005,835 | A * | 4/1991 | Huffman | 473/209 |
| 5,092,601 | A * | 3/1992 | Rilling | 473/215 |
| 5,984,796 | A * | 11/1999 | Mah | 473/215 |
| 6,800,035 | B1 * | 10/2004 | Couch | 473/213 |
| 7,383,728 | B2 * | 6/2008 | Noble et al. | 73/379.01 |

* cited by examiner

*Primary Examiner* — Nini Legesse
(74) *Attorney, Agent, or Firm* — Troutman Sanders LLP; Ryan A. Schneider

(57) ABSTRACT

Embodiments of the present invention are directed to systems and methods for alerting a golfer when he or she moves his or her head during a swing or stroke. According to an exemplary embodiment, a golf training aid comprises a movement detection mechanism and an alerting system. The training aid can comprise, for example, a support structure, such as a tube, and a weighed object, such as a ball. The weighted objet is located on or in the support structure, and the support structure is coupled to the golfer's headwear, such as a hat or visor. The weighted object is initially settled in a receiving portion of the support structure, but displaces when the golfer moves his head. The displacement alerts the golfer to the head movement, allowing the golfer to reduce or eliminate such movement from his or her golf game.

19 Claims, 5 Drawing Sheets

SYSTEMS AND METHODS FOR IMPROVING A GOLF SWING OR PUTTING STROKE

CROSS-REFERENCE TO RELATED APPLICATIONS AND PRIORITY CLAIM

This application claims priority under 35 U.S.C. §119(e) to U.S. Provisional Patent Application No. 61/526,866, entitled "Systems and Methods for Improving a Golf Swing," filed 24 Aug. 2011, the entirety of which is hereby incorporated by reference as if set forth in its entirety below.

BACKGROUND OF THE INVENTION

1. Field of the Invention

Various embodiments of the present invention relate to sporting equipment and, more particularly, to systems and methods for improving the head-stability of a golfer during a golf swing or putting stroke.

2. Description of Related Art

The game of golf is well known for being accessible to players of varying age groups and skill levels. The recreational and casual nature of golf has woven the game into many different aspects of modern life, from a family activity to an outdoor business meeting or negotiation. The great accessibility of this game may be one of the causes of the incredible market for golf training aids designed to improve the quality of play of golfers from amateurs to professionals.

One common problem in the swing or putting stroke of a golfer is undesirable movement of the golfer's head during the swing or putting stroke, which detracts from the proper spinal alignment necessary for a consistent and controlled motion. Many golfers instinctively lift their heads during or after a golf swing or putting stroke in order to attain visual feedback about the accuracy and/or trajectory of the ball path. Unfortunately, many amateur golfers raise their heads too early, either before or simultaneously with the club's strike upon the golf ball. By raising their heads too early, many of these golfers inadvertently misalign their spines, resulting in inaccurate shots. Accordingly, many individuals and corporations have attempted to solve this problem through the manufacture of various head-stability golf aids. Generally, these aids are designed to encourage golfers to keep their heads down, or to indicate, through a variety of means, when a golfer has inadvertently raised his or her head.

A variety of head-stability golf aids rely on visual cues in order to alert a golfer of improper head movement during a golf swing or putting stroke. One such device, described in U.S. Pat. No. 4,789,159, affixes a bubble level in the line-of-sight of the golfer, such that the golfer may self-identify whether the golfer's head is improperly aligned or whether the golfer's head alignment changes during the swing or putting stroke. Another device, described in U.S. Pat. No. 4,896,375, provides a visual indication of the direction that a golfer's head is pointed using a line marked on the underside of a hat brim. Both of these devices, as well as other devices reliant upon a golfer's own field-of-vision, require the golfer to split attention between the swing or stroke and the use of the aid. Furthermore, many of these visual-based aids interfere with the field-of-view of the golfer, distancing the training experience from the unobstructed field-of-view experienced when performing the golf swing or putting stroke on the golf course or putting green.

Another type of head-stability golf aid involves the use of a ground-mounted arm that either holds the golfer's head stationary or moves with the golfer's head to show the difference in head position from the start of the swing or stroke to its conclusion. These devices are large and obtrusive to the ordinary golfer, and may be too complicated or costly for the average golfing enthusiast. These devices also create variables in a training environment that are not present in a performance environment. Specifically, these devices apply pressure to a golfer's head in a manner that obstructs a completely free range-of-motion.

A third class of device developed to help improve head-stability during a golf swing or putting stroke involves the attachment of an electrical device to headgear worn by a golfer. One such device, detailed in U.S. Pat. No. 5,108,104, utilizes a mercury-based level coupled to an electronic timer and switch. This device determines whether the golfer's head has deviated from an optimal position for a certain, predetermined period of time. Other such devices use electronic accelerometers to determine the direction that a golfer's head is pointed, or the direction that a golfer's head has moved, during a swing or putting stroke. These devices are excessively costly and complex for the ordinary amateur golfer, who may not be prepared to invest significant money into an electronic head-stability aid. Similarly, an amateur golfer may be intimidated by the complexity of calibrating and using an electronic head-stability aid.

Accordingly, there exists a need for a relatively inexpensive head-stability aid that is accessible to both the amateur and professional golfing communities such that golfers from a wide range of skill-levels may improve their golf swings or putting strokes and better appreciate a day on the golf course. There exists a further need in the art for an accessible head-stability aid that does not interfere with the performance environment of the golfer, such as the golfer's field-of-view.

BRIEF SUMMARY OF THE INVENTION

Briefly described, the present invention is directed to systems and methods for alerting a golfer when he or she moves his or her head during a golf swing or putting stroke. The present invention can be a golf training aid comprising a movement detection mechanism and an alerting system. The movement detection mechanism can determine whether the golfer has moved his or her head from a relatively level position, and the alerting system can alert the golfer when such a movement occurs.

In some embodiments, the movement detection mechanism and alert system comprise a support structure, such as a tube, and a weighed object, such as a ball. The weighted objet is located on or in the support structure, and the support structure is coupled to the golfer's headwear, such as a hat or visor. The support structure can be coupled to the crown, bill, or brim of a visor, or to the bill or brim of a hat, for example.

In exemplary embodiments, the weighted object is initially settled in a receiving portion of the support structure. When the golfer moves his or her head, however, the weighted object displaces and moves along the support structure. The displacement of the weighted object comprises the alert system, which can cause a noise or feeling, among other sensory alerts, that indicates to the golfer that he or she is moving his or her head. This enables the golfer to practice to reduce or eliminate such movement from his or her golf game.

The movement detection mechanism can comprise one or more accelerometers that can detect motion of the golfer's head. In some embodiments, the accelerometers can detect motion in both the vertical and horizontal directions. The accelerometers can be configured to function in conjunction with hardware and/or software that trigger the alert system, through audio, tactile, or visual stimulus, that he or she has moved his or her head during a swing or stroke. The hardware and or software can additionally be programmed a golfer's skill level, alerting high level golfers of minor movement and lower level golfers of only significant movement.

The present invention is a training device that is accessible, inexpensive, and unobtrusive. The device can provide desired feedback to a golfer without interfering with the golfer's performance environment, such as field of view, while remaining easy to use and avoiding interference with the golfer's natural swing or stroke.

Embodiments of the present invention can comprise a system for indicating movement of a user's head. The system can comprise a movement detection mechanism and an alerting system. The movement detection mechanism can be coupleable to an article disposed on a user's head, and, upon detection of movement of a user's head by the movement detection mechanism, the alerting system can be activated, alerting a user of head movement.

In some embodiments, the movement detection mechanism can comprise a support structure and a weighted object, and movement of a user's head can cause the weighted object to move along the support structure. Moreover, the weighed object can activate the alerting system when the weighted object moves along the support structure.

In some embodiments, the movement detection mechanism can comprise an accelerometer configured to detect movement, or acceleration, of a user's head, and the accelerometer activates the alerting system when the accelerometer detects a threshold amount of acceleration. In some embodiments, the threshold amount of acceleration can be adjustable. Moreover, the movement detection mechanism can comprise at least two accelerometers configured to detect acceleration in substantially perpendicular directions. The alerting system can also comprise one or more of a tactile alert and an audio alert.

Embodiments of the present invention can also comprise a system for indicating movement of a user's head. The system can comprise a support structure coupleable to an article disposed on a user's head, a weighted object operable to move along the support structure, and a receiving portion for receiving the weighted object and restricting motion of the weighted object. Movement of a user's head can cause the weighted object to exit the receiving portion and move along the support structure, alerting a user of head movement.

In some embodiments, the support structure can be a tube and the weighted object can be disposed within the tube. Some embodiments can comprise an aperture in a sidewall of the tube opposite the receiving portion. Moreover, in some embodiments, the support structure can comprise two end caps restricting movement of the weighted object. The weighted object can be substantially spherical.

In some embodiments, the system can comprise an attachment mechanism for coupling the support structure to the article disposed on a user's head. The attachment mechanism can comprise a clip for attaching to at least a portion of the article disposed on a user's head and a gripping portion for gripping the support structure. Moreover, in some embodiments, the support structure can rotate within the gripping portion.

Embodiments of the present invention can also comprise a golf training aid. The golf training aid can comprise a tube containing a substantially spherical ball, and the tube can have a receiving portion located on a sidewall proximate the center of the tube. The receiving portion can be operable to receive the ball and restrict movement of the ball. The golf training aid can also comprise an attachment mechanism for removably attaching the tube to an article of clothing on the head of a user. The ball can be configured to rest in the receiving portion and can be displaced by movement of the tube, the displacement of the ball alerting a user of head movement.

In some embodiments, the tube can comprise sensors to detect the distance the ball travels. The tube can also comprise a thumb hole opposite the receiving portion. In some embodiments, the tube can be removably disposed within two gripping portions of the attachment mechanism, and the tube can rotate within the gripping portions.

In some embodiments, the attachment mechanism is configured to removably attach to an article of clothing. The attachment mechanism can be configured, for example, to removably attach to one or more of the bill, brim, and crown of an article of clothing. In some embodiments, the ball is displaced from the receiving portion when the tube rotates laterally approximately 3 degrees.

These and other objects, features, and advantages of the recruiting system will become more apparent upon reading the following specification in conjunction with the accompanying drawing figures.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION

Figure 1:
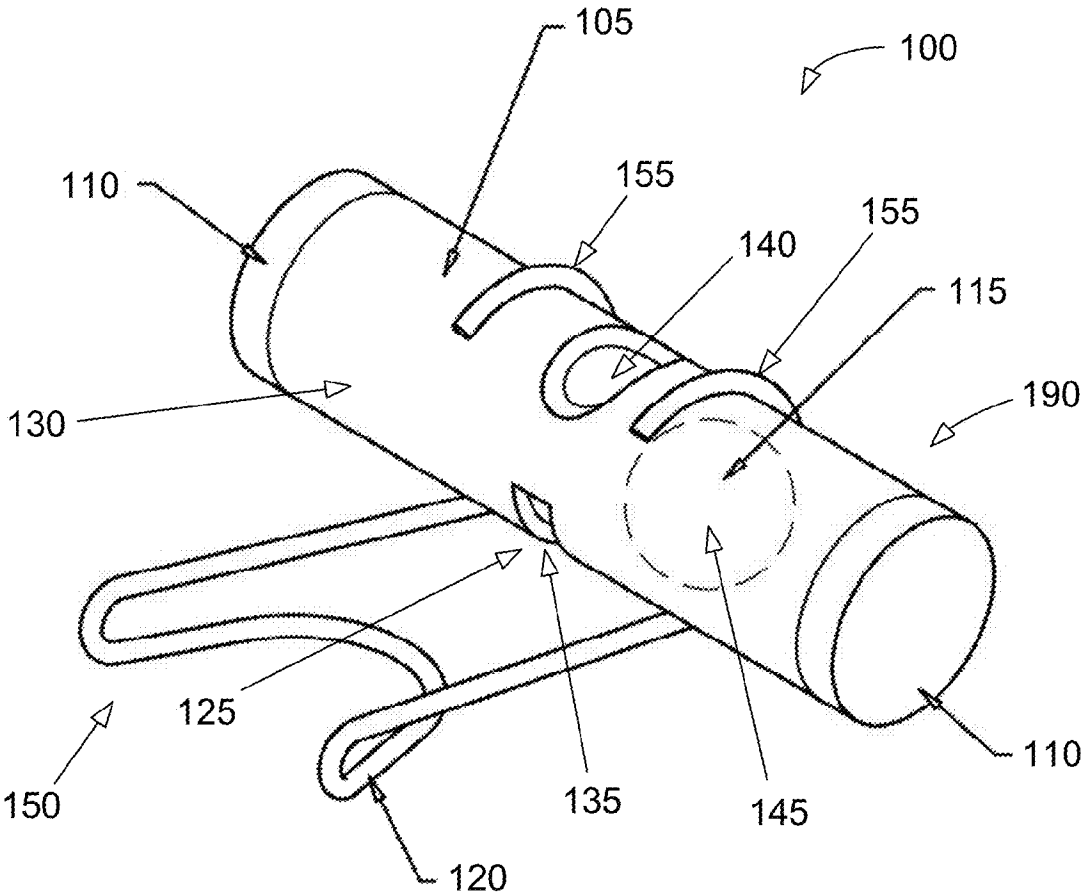
FIG. 1 is a perspective view of a golf training aid, in accordance with some embodiments of the present invention.

To facilitate an understanding of the principles and features of the various embodiments of the invention, various illustrative embodiments are explained below. Although exemplary embodiments of the invention are explained in detail as being a golf training aid, it is to be understood that other embodiments are contemplated, such as embodiments that serve as training aids for other purposes. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components.

References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

To facilitate an understanding of the principles and features of the present invention, various illustrative embodiments are explained below. In particular, various embodiments of the present invention are described as systems and methods for improving head-stability during a golf swing or putting stroke. Although exemplary embodiments of the invention are described herein with reference to the sport of golf, some aspects of the invention may be applicable to other contexts, and embodiments employing these aspects are contemplated. For example, and not limitation, some exemplary embodiments of the invention may improve the movements inherent in other sports, such as tennis, baseball, or curling. Some exemplary embodiments may also have applications outside of the sports context, such as with etiquette or handwriting classes. Accordingly, where the terms "golf," "golfer," and "swing or stroke," and related terms, are used throughout this disclosure, it will be understood that other entities, sports, or activities can take the place of these in various embodiments of the invention.

Figure 2:
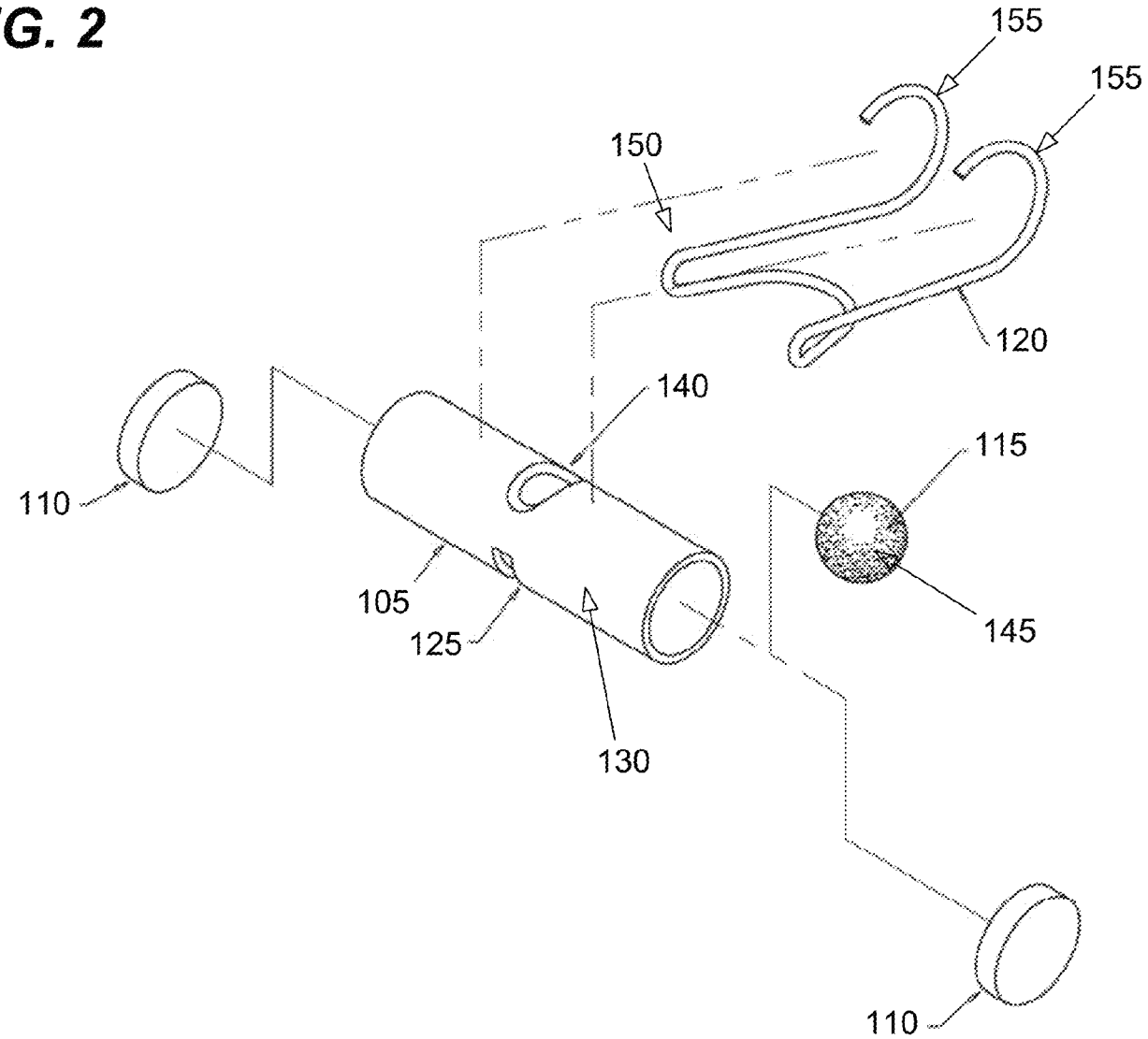
FIG. 2 is an exploded, perspective view of a golf training aid, in accordance with some embodiments of the present invention.

FIGS. 1-2 illustrate a golf training aid 100 in accordance with an exemplary embodiment of the present invention. The golf training aid 100 can comprise a movement detection mechanism 190 and an alerting system for alerting a golfer when the movement detection mechanism 190 senses that the golfer's head has moved. In this manner, the present invention can determine whether the golfer has moved his or her head from a relatively level position and alert the golfer to this fact. Thus, the present invention can encourage golfers of all skill levels to maintain a "head still" position while swinging or putting.

Those of skill in the art will note that not all golfers desire a perfectly level head when the take a golf swing or putting stroke. Some golfers, for example, may position their heads a few degrees off horizontal. In these cases, embodiments of the present invention will still be effective, as movement of the head, as opposed to its slight offset from horizontal, will cause the present invention to alert the golfer of a defect in his or her swing or stroke.

Those of skill in the art will also note that different golfers may desire to be alerted to different amounts of movement. A professional golfer, for example, may desire to be alerted to even the slightest movement, such as a 0.1 or 0.5 degree movement, while a beginning golfer may only desire to be alerted to significant movement, such as a 3 or 4 degree movement. Embodiments of the present invention accommodate both of these scenarios, as well as several others, including scenarios alerting the golfer to movement between 0.1 and 40 degrees.

As shown in FIGS. 1-2, the movement detection mechanism 190 of the training aid 100 can comprise a support structure 105 with end caps 110, a displaceable weighted object 115, and an attachment mechanism 120. The attachment mechanism 120 may be attached to the crown or bill of a visor, or to the bill of a cap, hat, or other headwear. In this manner, as will be described below, the training aid 100 can alert a golfer when the golfer moves his or her head during a swing or putting stroke. With this information, the golfer can practice to reduce or eliminate head movement from his or her golf game.

As noted above, embodiments of the present invention may be attached to the crown or bill of a visor, the bill of a hat, or to other headwear traditionally used by golfers to protect their eyes and faces from bright sunlight and harmful ultraviolet rays on the golf course. The present invention is therefore advantageous in that it is lightweight and does not require the golfer to wear large, bulky, or obtrusive equipment. The golfer merely attaches the present invention to his or her headwear, and can receive coaching and/or training without the use of obtrusive or prohibitively expensive devices.

In some embodiments, such as those shown in FIGS. 1-2, the training aid 100 is designed so that the weighted object 115 is initially centered on or in the support structure 105. The weighted object 115 can settle in a receiving portion 125, enabling the weighted object 115 to be held still until the support structure 105 is displaced from horizontal by a predetermined amount. When the golfer moves his or her head and causes the support structure 105 to displace by at least the predetermined amount, the weighted object 115 can exit the receiving portion 125 and move along the support structure 105 to a subsequent position. This movement can be perceived by the golfer's sense of feel and/or hearing as the weighted object 115 moves from the initial position to the subsequent position. This perception alerts the golfer of head movement during the golfer's swing or putting stroke. The movement of the weighted object 115 on or in the support structure 105 is therefore a means for alerting a golfer that his or her head has moved.

In an illustrative example, the weighted object 115 may move in or along the support structure 105 from the center to the right side, indicating to the golfer that he or she moved or tilted his or her head to the left during the golfer's swing or putting stroke. Alternatively, the weighted object 115 may move along the support structure 105 from the center to the left side, indicating to the golfer that he or she moved or tilted his or her head to the right during the golfer's swing or putting stroke. Accordingly, a lack of movement of the weighted object 115 from the initial centered position to a subsequent position may notify the golfer of proper head control or stability during the golfer's golf swing or putting stroke. Likewise, any movement may indicate improper control or stability.

When a golfer's head does not move, the golfer may notice a lack of movement, or a negligible amount of movement, in the weighted object 115 throughout his or her golf swing or putting stroke. With continued use of the present invention, a golfer may develop a sense of confidence and consistency that may enable the golfer to maintain his or her head still during a golf swing or putting stroke, resulting in a more consistent and accurate golf shot.

Figure 3:
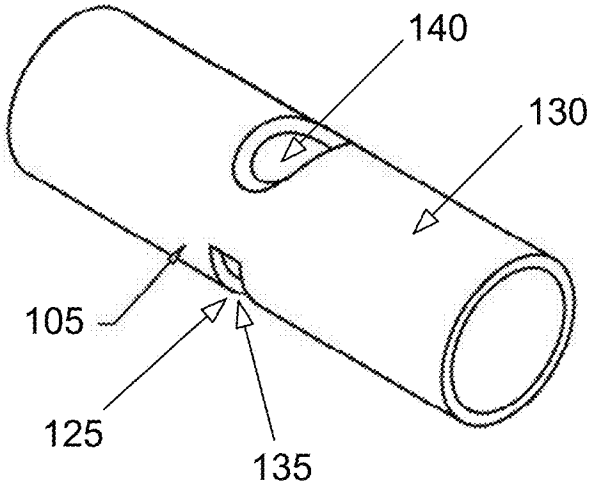
FIG. 3 is a perspective view of a support structure, in accordance with some embodiments of the present invention.
Figure 5:
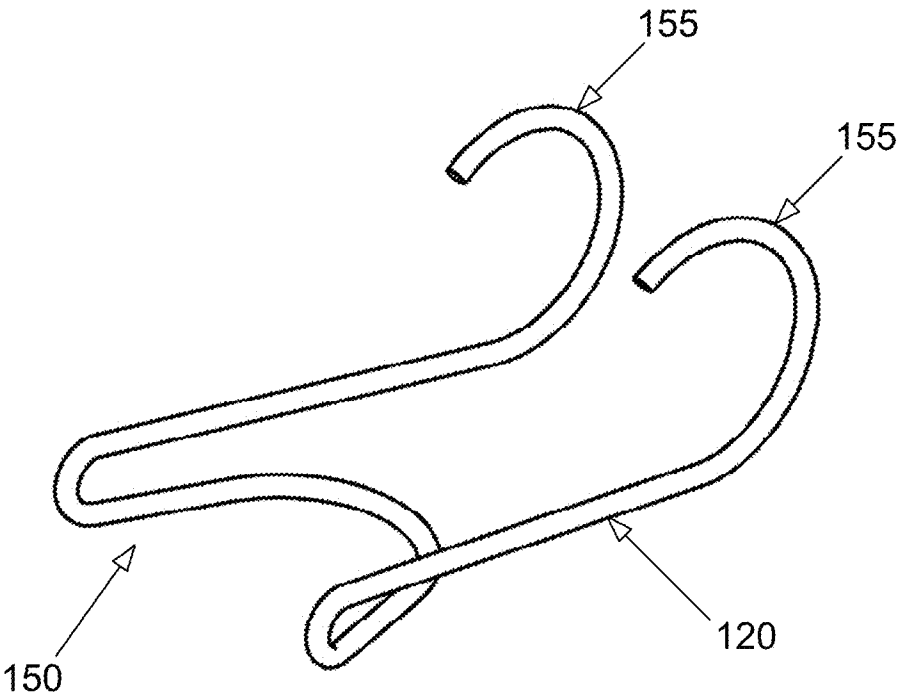
FIG. 5 is a perspective view of an attachment mechanism, in accordance with some embodiments of the present invention.

As shown in FIG. 3, in some embodiments, the support structure 105 comprises a tube 130. In these embodiments, the weighted object 115 can be disposed within the tube 130. In other embodiments, however, the support structure 105 can comprise a trough or tray, and the weighted object 115 can be disposed on an outer surface of the trough or tray, optionally within a channel.

Aspects of the invention contemplate the use of different widths, lengths, depths and diameters of tubes 130, troughs, and trays in various embodiments of the invention in order to provide for the use of different weighted objects 115 tailored to different skill levels, as described herein. It will be appreciated by those of ordinary skill in the art that other forms of support structures 105, in addition to a tube 130, trough, or tray, may be used in other embodiments of the present invention.

In exemplary embodiments having a tubular support structure 105, the tube 130 can be a variety of lengths, diameters, and thicknesses, and can be made from a variety of materials. In some embodiments, for example, the tube 130 is between 1 and 6 inches long, often between 2 and 3 inches long. Moreover, in some embodiments, the tube 130 can have an inner and outer diameter that are both between 0.2 and 2 inches, often between 0.2 and 1 inches. In some embodiments, for example, the outer diameter is 13/16 of an inch, and the inner diameter is 11/16 of an inch.

The dimensions described above provide a tube 130 that is small enough to avoid being cumbersome in use. Thus, the tube can be attached to headwear of a golfer without being obtrusive or distracting to the golfer. These dimensions also provide a tube 130 that is large enough to allow movement of the weighted object 115 inside the tube 130, thereby providing the golfer with the ability to sense movement, if any. The tube 130 can comprise aluminum, steel, copper, PVC, composites, or various other metals or plastics, among other materials. In some embodiments, the tube 130 comprises schedule 40 thin-wall PVC.

Embodiments of the present invention can also comprise a receiving portion 125 disposed proximate the center of the tubular support structure 105. In some embodiments, the receiving portion 125 is a slot 135 that is cut into the sidewall of the tube 130. In other embodiments, the receiving portion 125 is a recess disposed between two or more ridges on or inside the support structure 105. The receiving portion 125 is positioned proximate the bottom of the tube 130, thereby allowing the weighted object 115 to settle in the receiving portion 125. This can provide a steady initial position for the weighted object 115, which can allow a golfer to reset the training aid 100 before the first swing or stroke or between subsequent swings or strokes.

In practice, the receiving portion 125 can center or level the weighted object 115 while the weighted object 115 is in its initial, undisturbed state. The receiving portion 125 keeps the weighted object 115 still, and prevents unintended movement of the weighed object when the training aid 100 is being coupled to the golfer's headwear, or before the golfer has raised or moved his or her head during a swing or stroke. The receiving portion 125 also provides a location for return of the weighted object 115 after a golfer has hit one stroke, and intends to reset the training aid 100 in order to hit another.

In some embodiments, the receiving portion 125 is between 0.1 and 0.5 inches wide, meaning that a slot 135 or recess can have this width. In an exemplary embodiment, for example, the receiving portion 125 is 1/8 of an inch wide. The receiving portion 125 can also have a variety of lengths, and in exemplary embodiments, can be approximately 1.25 inches long.

In some embodiments, a thumb hole 140 is disposed in the tubular support structure 105. The thumb hole 140 can be located substantially opposite the receiving portion 125, in the top of the support structure 105. The thumb hole 140 allows a golfer to make physical contact with the weighted object 115 as the golfer sets the weighted object 115 into its initial position. This can ensure that the weighted object 115 is resting in the receiving portion 125, and is therefore still and centered, before the golfer uses the training aid 100. As those of skill in the art will note, the thumb hole 140 can be a variety of shapes and sizes. In an exemplary embodiment, for example, the thumb hold is circular and has a diameter of approximately 0.5 inches.

Embodiments of the present invention can further comprise end caps 110 disposed on the ends of the support structure 105. The end caps 110 can serve to retain the weighted object 115 within or on the support structure 105, i.e., within the tube 130 or on the trough or tray. In some embodiments, for example, a tube 130 can be sealed at each end with end caps 110, and the diameter of the end caps 110 can match the outer diameter of the tube 130.

The end caps 110 can be attached to the support structure 105 in a variety of ways. In some embodiments, for example, the end caps 110 can be glued or cemented in place by one or more of a variety of adhesives, such as traditional glue or PVC cement. In other embodiments, the end caps 110 can be threaded and screwed into the tube 130, or a mechanical fastener, such as a screw or nail, can be employed. Other mechanical devices and adhesives known to those of skill in the art can also be used to attach the end caps 110 to the support structure 105. Thus, in some embodiments, the weighted object 115 can be permanently sealed inside of the tube 130 by the end caps 110, and in other embodiments the end caps 110 can be displaced to enable removal of the weighted object 115. The end caps 110 can be made from the same material as the support structure 105, such as a material listed above, or from a different material.

Various embodiments of the invention further contemplate a variety of contours of the surface against or through which the weighted object 115 travels. The contours can be designed based on a skill level of a golfer. In an exemplary embodiment, the contour of the support structure 105 can comprise a relatively steep angle, such that only large or major movements of the golfer's head cause the weighted object 115 to move from a centered position to a subsequent position. Similarly, the contour of the support structure 105 can comprise one or more large raised sections or bumps to prevent movement of the weighted object 115 until the golfer's head moves a large or major amount. In another exemplary embodiment, the contour of the support structure 105 can follow a relatively flat angle, such that small or minor movements of the golfer's head cause the weighted object 115 to move from a centered position to a subsequent position. Similarly, the contour of the support structure 105 can comprise one or more small raised sections or bumps that only prevent movement of the weighted object 115 when the golfer's head undergoes incrementally small movements. Still other embodiments of the present invention may provide for other non-uniformly smooth surfaces in or on the support structure 105. These surfaces, such as ridges or bumps, may hold the weighted object 115 in place during small or minor head movements, yet may allow the weighted object 115 to move when larger or major head movements are performed by the golfer.

Aspects of the present invention further contemplate a range of subsequent positions to which the weighted object 115 can move, such that movement to different positions signifies acceptable or unacceptable head movement or stability during a golf swing or putting stroke. In some embodiments, for example, the weighted object 115 may move from the center of the support structure 105 to an outer, but not terminal, portion of the support structure 105. This movement can indicate some head motion, but less than an extreme amount. Furthermore, a variety of areas to receive the weighted object 115 may be identified such that a golfer may determine the severity or amount of movement occurring during the golf swing or putting stroke.

Each of these areas can by indicated by a depression, hole, or other receiving means into which the weighted object 115 can settle. In an exemplary embodiment, the weighted object 115 settles into an area near an extreme end of the support structure 105 when the golfer's head movement is severe, and settles into an area near the center of the support structure 105 when the golfer's head movement is subtle.

The present invention can further comprise a viewing window integrated into the support structure 105. The viewing window is especially helpful in embodiments comprising a tubular support structure 105 that would otherwise be opaque. The viewing window provides a means by which the golfer, or a nearby companion, can determine the degree to which the weighted object 115 has moved, and thus the degree to which the golfer has moved his or her head.

In various aspects and embodiments of the invention, the weighted object 115 is contemplated to be one or more of a wide variety of objects or materials. As shown in FIGS. 1 and 2, for example, the weighted object 115 can be a ball 145 or other substantially spherical object. Moreover, in some embodiments, the weighted object 115 can be made of steel, and can optionally be coated with chrome. In some embodiments, however, the weighted object 115 can be made of lightweight material, such as plastic, nylon, or composite, in order to reduce the weight of the training aid 100.

The present invention provides a convenient manner for determining whether improper head movement is present in a golf swing or putting stroke without the need for additional devices. More specifically, a golfer can determine whether he or she is improperly moving his or her head based on whether or not the golfer can sense, through feeling or hearing, movement of the ball 145 or other weighted object 115 on or in the support structure 105. More particularly, as the weighted object 115 moves in either direction, the movement of the weighted object 115 can be felt by the user. Moreover, upon contacting either end of the tube 130, the weighted object 115 causes an audible click, which can be heard by the user. In some embodiments, the rolling or movement of the weighted object 115 can also be heard by the user. In all of these instances, the movement of the weighted object 115 serves as an alerting means to the golfer that his or her head is moving.

In some embodiments, the weighted object 115 can be a chrome and/or steel ball 145. The ball 145 can be, for example, a steel bearing ball 145, and can optionally be coated in chrome. The ball 145 can also comprise a variety of diameters. In some embodiments, for example, the ball 145 can have a diameter between 0.2 and 2 inches. In an exemplary embodiment, the ball 145 has a ⅝ of an inch diameter.

In additional embodiments of the invention, a weighted object 115 may be provided that is sized, shaped, or weighted to interact with head movement based on the skill level of a golfer. In one instance, for example, the weighted object 115 may be substantially spherical such that the weighted object 115 may move relatively freely. The substantially spherical weighted object 115 may be helpful for more skilled golfers who would like to be alerted to finer movements during their golf swing or putting stroke. In another instance, the weighted object 115 may be extruded or flattened in one or more directions, such that it does not roll as easily or as a perfectly as a spherical object. These types of weighted objects 115 may provide less sensitive training devices and methods which can be desired by less-experienced golfers or golfers who are concerned with more pronounced movements during their golf swing or putting stroke. Still other aspects of the invention contemplate other shapes of weighted objects 115, such as, without limitation, cubes, rectangular prisms, and prisms of various shapes and sizes, as well as numbers of sides, in order to affect different training experiences and motion sensitivities.

Additional embodiments and aspects of the invention contemplate weighted objects 115 of varying weight, in order to allow a golfer to select a training device that may be comfortable to use while providing the desired level of feedback. In some embodiments, the weight of the weighted object 115, shape and size of the weighted object 115, and shape and size of the receiving portion 125, among other factors, can be selected such that the weighted object 115 rests in the receiving portion 125 until the head of the golfer rotates by a predetermined amount. The predetermined amount can vary based on a particular golfer's skill level, among other factors. When this predetermined limit is reached, the weighed object can exit the receiving portion 125, alerting the golfer that his or her head has rotated out of position. In this manner, in embodiments for expert golfers, the weighted object 115 exits the receiving portion 125 after less movement than it does for beginning golfers.

In some embodiments, moreover, the receiving portion 125 can comprise beveled edges, with the degree of the bevel influencing the predetermined amount at which the weighted object 115 exits the receiving portion 125. The predetermined amount can be a little as 0.1 degrees, or as much as 40 degrees.

Figure 4:
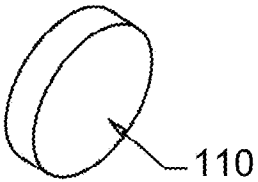
FIG. 4 is a perspective view of an end cap for a support structure, in accordance with some embodiments of the present invention.

As shown in FIG. 4, embodiments of the present invention can additionally comprise an attachment mechanism 120 for attaching the support structure 105 to a golfer's article of clothing. The attachment mechanism 120 can, for example, attached the support structure 105 to an article of headwear, such as the brim or bill of a hat or visor, or the crown of a visor.

In some embodiments, the attachment mechanism 120 can comprise a receiving portion 125 for receiving an article of headwear. The receiving portion 125 can comprise, for example, a clip 150 or another known attachment device. The attachment mechanism 120 can further comprise a gripping portion 155 for gripping the support structure 105. In exemplary embodiments, the attachment mechanism 120 comprises two gripping portions 155 for gripping the support structure 105, and one of the two gripping portions 155 is disposed on each side of the receiving portion 125 located proximate the center of the tube 130. In this manner, the gripping portions 155 can adequately grip and balance the support structure 105, even when the golfer moves his or her head a substantial amount. Moreover, the support structure 105 can be rotated within the gripping portions 155 to ensure that the support structure 105 is properly positioned on the headwear, i.e., with the thumb hole 140 on the top of the support structure 105 and the slot 135 on the bottom of the support structure 105. This configuration allows for easy centering of the weighted object 115 between swings or strokes by a golfer without requiring that the golfer remove the training aid 100 from his or her headwear.

In some embodiments, the attachment mechanism 120 can comprise steel wire. The attachment mechanism 120 can be fabricated, for example, with 12 AWG wire approximately 10 inches in length. The attachment mechanism 120 can be formed by bending the wire in such a way that the support structure 105 can be held firmly in place, and in such as way that there is sufficient tension in the clip 150 to hold the training aid 100 in place on the golfer's headwear.

Aspects and embodiments of the present invention can also comprise one or more sensor devices. These sensor devices can be located on or in the support structure 105, and can utilize pressure sensitivity, conductivity, or any other form of sensing known now or later known to those of ordinary skill in the art. The sensors may be configured and positioned such that when a weighted object 115 moves to a subsequent position on either side of the receiving portion 125, an alert is triggered. Thus, the sensors may work in conjunction with hardware and/or software to sense the position of the weighted object 115 and trigger an alert.

Various embodiments of the present invention contemplate a variety of distances from the receiving portion 125 to the one or more sensors, so as to accommodate the desires of golfers of varied skill levels. More particularly, high level or professional golfers may prefer embodiments with sensors positioned close to the receiving portion 125 in order to alert the golfers of any movement of the weighted object 115, however small. Lower level golfers, however, may prefer embodiments with sensors positioned further from the receiving portion 125, in order to limit the alerts to instances where the weighted object 115 moves larger distances. In some embodiments, multiple sensors may be placed on either or both sides of the center of the support structure 105, such that multiple discernable alerts can be provided to the golfer depending on the movement of the weighted object 115. In this case, the alerts may identify the severity of the movement to the golfer.

Figure 6:
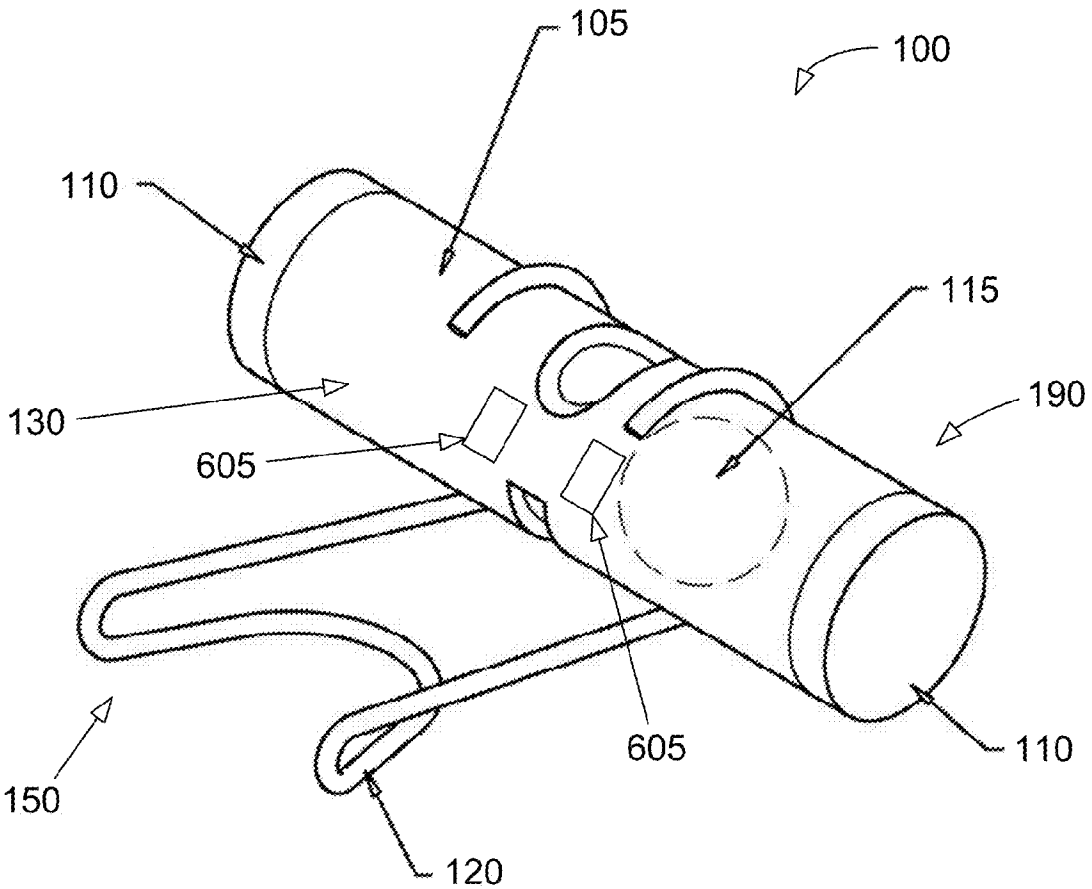
FIG. 6 is a perspective view of a golf training aid employing accelerometers, in accordance with some embodiments of the present invention.

As shown in FIG. 6, in some embodiments, the movement detection mechanism 190 of the training aid 100 can comprise at least one accelerometer 605. The accelerometer 605 can detect acceleration, and thus motion, and can be configured, through the use of electronic hardware and/or software, to alert the golfer that his or her head has changed position. The accelerometer 605 can be coupled to one or more of an attachment mechanism 120 and a support structure 105, and can therefore be attached to the golfer's headwear.

Moreover, in some embodiments, the accelerometer 605 and accompanying hardware and/or software is programmed to alert the golfer of movement only when a predetermined amount of movement has occurred. Thus, the training aid 100 can be programmed so that a golfer can select his or her skill level, which corresponds to a level of sensitivity. In some embodiments, this skill level is variable for a given training aid 100. Thus, in an exemplary expert or professional mode, the accelerometer 605 can trigger an alert when the golfer's head accelerates by only a small amount or moves only a small amount. In an exemplary beginner mode, however, the accelerometer 605 will not trigger an alert until the golfer's head has accelerated or moved a larger amount. The accelerations and degree amount that trigger an alert are, of course, variable and adjustable to a variety of values, such as between 0.1 in/s$^2$ and 36 in/s$^2$, and between 0.1 and 40 degrees, respectively.

Embodiments of the present invention can comprise an accelerometer 605 that can detect acceleration in more than one direction. Similarly, embodiments of the present invention can comprise two or more accelerometers 605 mounted to detect acceleration in different directions, such as substantially perpendicular directions. Thus, embodiments of the present invention can be configured to detect both horizontal and vertical motion, allowing the training aid 100 to indicate when a golfer has vertically raised or horizontally rotated his or her head, for example.

Various aspects and embodiments of the present invention contemplate the use of different methods of alerting the golfer when a sensor or alert is triggered. In some embodiments of the invention, an auditory alert may be triggered. The auditory alert may be created passively, such as by contact between the weighted object 115 and a hard surface, or actively, such as through the use of electronics. In some instances of the invention, a different tone or alert may be used to identify to the golfer the direction or severity of an undesired movement. In still other embodiments of the invention, other types of alerts may be generated, such as, but not limited to, vibration and visual alerts. Thus, a variety of alerts, such as speakers, vibrating devices, visual indication devices, and the like can be employed. Moreover, embodiments of the present invention include wireless or remote alerts directed to a separate device, such as a smart-phone or computer. Those of ordinary skill in the art will appreciate that any combination of alerts may be used in any order in the present invention.

Those of skill in the art will recognize that the movement detection mechanism 190 of the present invention can be a wide variety of devices, beyond the devices described above. The movement detection mechanism 190 can be, for example, various types of movement or level detection mechanism known or used in the mechanical arts.

It will be appreciated by those of ordinary skill in the art that various embodiments and aspects of the present invention can be directed to types of headwear, in addition to independent training aids 100. Embodiments of the invention, for example, can be derived to attach to baseball 145 caps, headbands, and any other form of headwear now or later known.

While golf swing or putting stroke improvement systems and methods have been disclosed in some exemplary forms, many modifications, additions, and deletions may be made without departing from the spirit and scope of the system, method, and their equivalents. The embodiments and claims disclosed herein are further capable of other embodiments and of being practiced and carried out in various ways. Also, it is to be understood that the phraseology and terminology employed herein are for the purposes of description and should not be regarded as limiting the claims.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A system that alerts a user of head movement, the system comprising:

a movement detection mechanism comprising:

a weighted object; and a support structure having a slot cut into the sidewall of the support structure, the slot for receiving the weighted object and restricting motion of the weighted object;

wherein the movement detection mechanism is coupleable to an article disposed on a user's head; and wherein movement of the user's head causes the weighted object to exit the slot and move along the support structure, alerting the user of head movement.

2. The system of claim 1, wherein the movement detection mechanism further comprises an accelerometer configured to detect acceleration of the user's head; and wherein the accelerometer activates an alerting system when the accelerometer detects a threshold amount of acceleration.

3. The system of claim 2, wherein the threshold amount of acceleration is adjustable.

4. The system of claim 2, wherein the movement detection mechanism comprises at least two accelerometers configured to detect acceleration in substantially perpendicular directions.

5. The system of claim 2, wherein the movement detection mechanism comprises an accelerometer configured to detect acceleration substantially perpendicular directions.

6. The system of claim 2, wherein the alerting system comprises one or more of a tactile alert and an audio alert.

7. A system for alerting a user of head movement, the system comprising:

a support structure coupleable to an article disposed on a user's head;

a weighted object operable to move along the support structure; and a receiving portion for receiving the weighted object and restricting motion of the weighted object, the receiving portion comprising one or more of a slot cut into the sidewall of the support structure and a recess disposed between two or more ridges on or inside the support structure;

wherein movement of a user's head causes the weighted object to exit the receiving portion and move along the support structure, alerting a user of head movement.

8. The system of claim 7, wherein the support structure is a tube and the weighted object is disposed within the tube.

9. The system of claim 8 further comprising an aperture in a sidewall of the tube opposite the receiving portion.

10. The system of claim 7, wherein the weighted object is substantially spherical.

11. The system of claim 7 further comprising an attachment mechanism for coupling the support structure to the article disposed on a user's head.

12. The system of claim 11, wherein the attachment mechanism comprises:

a clip for attaching to at least a portion of the article disposed on a user's head; and a gripping portion for gripping the support structure;

wherein the support structure can rotate within the gripping portion.

13. A golf training aid comprising:

a tube containing a substantially spherical ball, the tube having a receiving portion located on a sidewall proximate the center of the tube, the receiving portion comprising a recess disposed between two or more ridges on or inside the tube, the receiving portion operable to receive the ball and restrict movement of the ball; and an attachment mechanism for removably attaching the tube to an article of clothing on a head of a user;

wherein the ball is configured to rest in the receiving portion and is displaced by movement of the tube, the displacement of the ball alerting a user of head movement.

14. The golf training aid of claim 13, wherein the tube comprises sensors to detect the distance the ball travels.

15. The golf training aid of claim 13, wherein the tube comprises a thumb hole opposite the receiving portion.

16. The golf training aid of claim 13, wherein the tube is removably disposed within two gripping portions of the attachment mechanism, and wherein the tube can rotate within the gripping portions.

17. The golf training aid of claim 13, wherein the attachment mechanism is configured to removably attach to an article of clothing.

18. The golf training aid of claim 17, wherein the attachment mechanism is configured to removably attach to one or more of the bill, brim, and crown of an article of clothing.

19. The golf training aid of claim 13, wherein the ball is displaced from the receiving portion when the tube rotates approximately 3 degrees.

* * * * *